United States Patent [19]

Cone

[11] Patent Number: 4,807,928

[45] Date of Patent: Feb. 28, 1989

[54] TRAY APPARATUS FOR USE WITH A CHAIR

[75] Inventor: Richard E. Cone, Dayton, Ohio

[73] Assignee: Gerico, Inc., Denver, Colo.

[21] Appl. No.: 98,456

[22] Filed: Sep. 18, 1987

[51] Int. Cl.[4] ..... A47B 39/00

[52] U.S. Cl. ..... 297/153; 297/151

[58] Field of Search ..... 297/149, 153, 148, 154, 297/155, 156

[56] References Cited

U.S. PATENT DOCUMENTS

| | | | |
|---|---|---|---|
| 2,118,509 | 5/1983 | Heinritz | 297/151 |
| 2,505,490 | 4/1950 | Greenbaum | 297/151 |
| 2,540,685 | 2/1951 | Mayer | 297/182 |
| 2,684,110 | 7/1954 | Stone | 297/154 |
| 2,937,694 | 5/1960 | Willson et al. | 297/153 |
| 4,165,123 | 8/1979 | Hutson | 297/153 |
| 4,364,576 | 12/1982 | Kassai | 280/87.02 W |
| 4,373,756 | 2/1983 | Purdy et al. | 297/149 X |
| 4,606,576 | 8/1986 | James | 297/153 |
| 4,723,813 | 2/1988 | Kassai | 297/149 |

*Primary Examiner*—James T. McCall

*Attorney, Agent, or Firm*—Sheridan, Ross & McIntosh

[57] ABSTRACT

A tray apparatus is provided for attachment to a high chair. The tray apparatus includes a tray having a circular outer periphery. Raised arm or elbow rest areas are formed at the back of the tray. Peripheral portions, which are located at the back of the tray, decrease in height in a direction from the outer periphery. The tray apparatus also includes a latching mechanism that provides a number of functions including: adjustment of the tray relative to the high chair while maintaining engagement between the tray apparatus and the high chair; one-handed or two-handed removal of the tray apparatus from the high chair; and a memory feature which facilitates removal of the tray apparatus and attachment thereof at the same position relative to the high chair.

20 Claims, 6 Drawing Sheets

TRAY APPARATUS FOR USE WITH A CHAIR

FIELD OF THE INVENTION

This invention relates to chairs having trays, and more specifically to a tray apparatus for use with children's high chairs.

BACKGROUND OF THE INVENTION

Children's high chairs and trays for use with such high chairs are well known in the art. High chairs are primarily used to seat an infant or child too small to be seated in conventional chairs. The tray should be sufficiently secured to the chair so that the child's weight against the tray cannot inadvertently release the tray from the chair. At the same time, the tray should be removable in order to facilitate placing the child in the chair and subsequently removing the child from the chair. The tray provides a surface on which food, toys, etc. can be placed. Thus, the tray should be large enough to provide a large surface area, but at the same time the tray should not be so large so as to prevent a person located in front of the high chair from easily reaching the child seated in the chair. The tray also catches food, liquids, etc. which are spilled on it. Hence, the tray should be designed to contain such spills. In addition, the tray provides a convenient resting place for the child's arms. Therefore, the tray should accommodate the arms of a child in a comfortable manner.

The prior art discloses high chair trays of numerous shapes and sizes. U.S. Pat. Nos. 2,540,685 issued Feb. 6, 1951 to Mayer; 2,684,110 issued July 20, 1954 to Stone and 4,364,576 issued Dec. 21, 1982 to Kassai all show square or rectangular trays with rounded corners. It would be advantageous to use a chair that is not simply rounded at the corners but in which the outer periphery is a portion of a circle. This would provide a number of advantages. For instance, with a tray whose shape is that of a portion of a circle, the area of the tray can be increased with a relatively small corresponding increase in the distance between a child seated in the chair and the outer periphery of the tray. This is important because when a high chair is in use a child is typically seated in the chair and an adult sits or stands near the outer periphery of the tray to feed or play with the child. As a result, the distance between the outer periphery and the seated child can be kept to a minimum while the total surface area of the tray can be maximized. In addition, when the outer periphery of a tray is shaped as a portion of a circle, the distance from the child to all points on the outer periphery is nearly equal. Therefore, an adult seated at any location on the outer periphery is at a convenient distance from a child. This is not true when trays are square or rectangular in shape, even if the corners are rounded.

Another convenient feature which has been incorporated in prior art high chair trays is a raised periphery. (See, for example, U.S. Pat. Nos. 2,540,685; 2,684,110 and 4,364,576, cited above). This raised periphery or rim contains food and liquids spilled on the tray and helps to prevent spills from landing on the floor. However, the raised periphery can be uncomfortable for the child sitting in the chair. When the child rests his or her arms or elbows on the tray, the child encounters this raised rim which can cause discomfort. If the raised periphery were eliminated at that portion of the tray where the child rests his arms, spills onto the tray could run onto the child or the floor, thus defeating the purpose of the raised periphery. Therefore, it would be advantageous to have a tray designed to contain spills and yet where the comfort of the child in resting his or her arms upon the tray is provided for.

Various means to removably attach a tray to a high chair have been disclosed in the prior art. U.S. Pat. Nos. 2,118,509 issued May 24, 1938 to Heinritz and 2,505,490 issued Apr. 25, 1950 to Greenbaum both disclose means for removably attaching a tray to a high chair, and with such means being operable with one hand. in general these mechanisms address the desirable feature of removing a tray from a high chair with one hand, while leaving the other hand free to carry the infant or child to be seated in the high chair.

Another feature desirable in a high chair tray is adjustability toward or away from a child seated in the chair. Although U.S. Pat. No. 2,505,490 recognizes the benefits of a high chair tray which is removable with one hand and yet is securely attached to the high chair, so that the weight of a child pushing against a tray will not cause the tray to disengage from the chair, it does not address this problem during the critical period when the tray is being adjusted toward or away from the child. Stated in another way, the mechanism shown in U.S. Pat. No. 2,505,490 is such that when the tray is being adjusted, it is not in any way secured to the chair. U.S. Pat. No. 2,118,509 suffers from this same disadvantage.

Therefore, even though an adult is typically holding onto the tray with one hand to adjust it, a child already seated in the chair may push against the tray causing it to become disengaged from the chair. It would be advantageous not only to have a tray which is removable and adjustable with one hand, but also one which is secured to the chair while the tray is being adjusted toward or away from the child.

The latching mechanism, which secures the tray to the chair and allows the tray to be adjusted in a horizontal direction, should not present any sharp edges or any connections where the child's legs could be pinched or injured while the child is seated in the chair. In both U.S. Pat. Nos. 2,118,509 and 2,505,490, the latching mechanisms on the underside of the tray are exposed thereby possibly creating dangerous "pinch points," which could cause injury to a child.

Another problem associated with latching mechanisms of the type disclosed in U.S. Pat. Nos. 2,118,509 and 2,505,490 is the manner in which the tray is secured to the chair. Typically, the tray is supplied with spring biased engagement means such as pegs or teeth, which are urged into corresponding engagement means located on the arms of the chair, such as holes for the pegs, or corresponding teeth. In order to provide for adjustment of the tray in a horizontal direction, a plurality of engagement means are provided at various positions along the arm so that the tray may be positioned closer to or further from the back of the chair. This type of latching mechanism suffers from a number of disadvantages. As already mentioned, the tray must be disengaged from the chair in order to allow for adjustment. This can be unsafe. Another disadvantage is that the horizontal adjustment must be re-done each time the tray is removed from the chair. In other words, the prior art adjustable trays do not automatically return to the same position each time the tray is removed then replaced on the chair. Yet another disadvantage is that prior art engagement means located on the chair tend to be small in size and careful alignment is required in order to secure the tray to the chair. It would be advantageous to provide: (1) a latching mechanism that remains secured to the chair while the tray is adjusted in a horizontal direction, (2) a latching mechanism that incorporates a "memory" feature which allows the tray to return to the same position relative to the chair each time it is removed and replaced, and (3) engagement means of a larger size so that alignment between the tray and the engagement means or attachment area of the high chair arm is easily accomplished when the tray is secured to the chair.

SUMMARY OF THE INVENTION

The present invention provides a high chair tray with a novel configuration and a unique latching mechanism. The novel configuration of the present tray provides a number of advantages. The outer periphery of the tray is a portion of a circle and therefore an adult seated alongside the outer periphery is located at a convenient distance from the child no matter where along the outer periphery the adult is seated. A raised outer periphery is provided in order to contain spills on the tray. However, the comfort of the child has been taken into account in a novel manner. First of all, raised areas towards the back of the tray have been provided on which the child may rest her arms. These raised areas are adjacent to slanted peripheral portions formed at the back of the tray for use in collecting spills inside the outer periphery where they are contained by the raised rim, as well as still providing comfort for the child's arms or elbows. A recessed area or section is provided towards the front of the tray where food, toys, etc. may be placed.

The unique latching mechanism of the present tray provides a number of advantages over the prior art. It has a novel memory feature which enables the tray to be located back at the same position each time the tray is removed from the high chair. This is beneficial because it eliminates the need for the tray to be adjusted each time it is removed. The latching mechanism provides for both one handed and two handed removal of the tray. One handed removal is often advantageous when an adult is carrying or holding a child with one hand and needs to remove the tray with the other hand. Two handed removal is convenient when it is desirable to keep the tray level because it is easier to balance. The tray is also adjustable with one hand. This adjustment takes place while the tray is still secured to the high chair. In other words, the adjustment mechanism can be operated independently of the removal mechanism, in spite of the fact that they are both part of the latching mechanism and they both share common components.

DETAILED DESCRIPTION OF THE INVENTION

Figure 1:
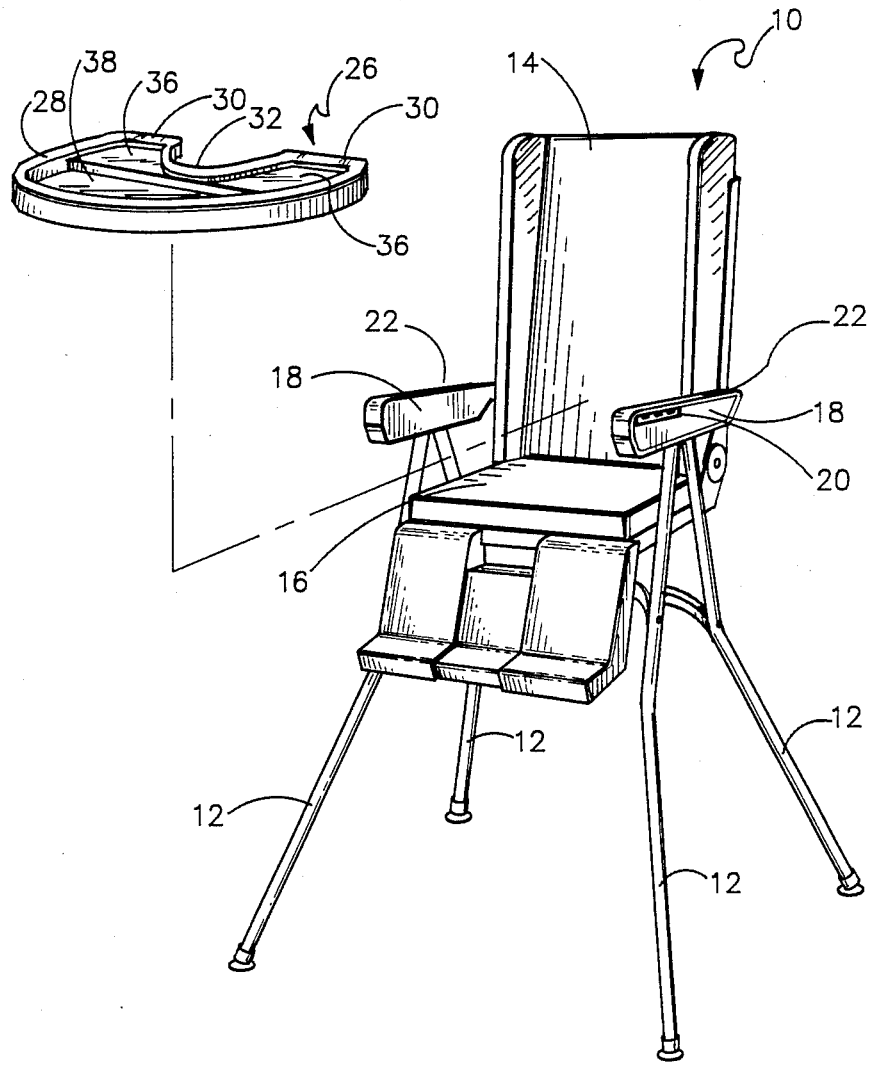
FIG. 1 is a perspective view showing a high chair with the tray of the tray apparatus removed from the chair.

Referring to FIG. 1, a high chair 10 is shown including four support legs 12 and having a back 14 and a supporting seat 16. The high chair 10 also has two arms 18. Each arm 18 has an engagement area 20 (only one shown) for receiving a tray latching mechanism, as will be explained in greater detail later. Each arm 20 is provided with an upper surface 22 which is substantially horizontal.

Figure 2:
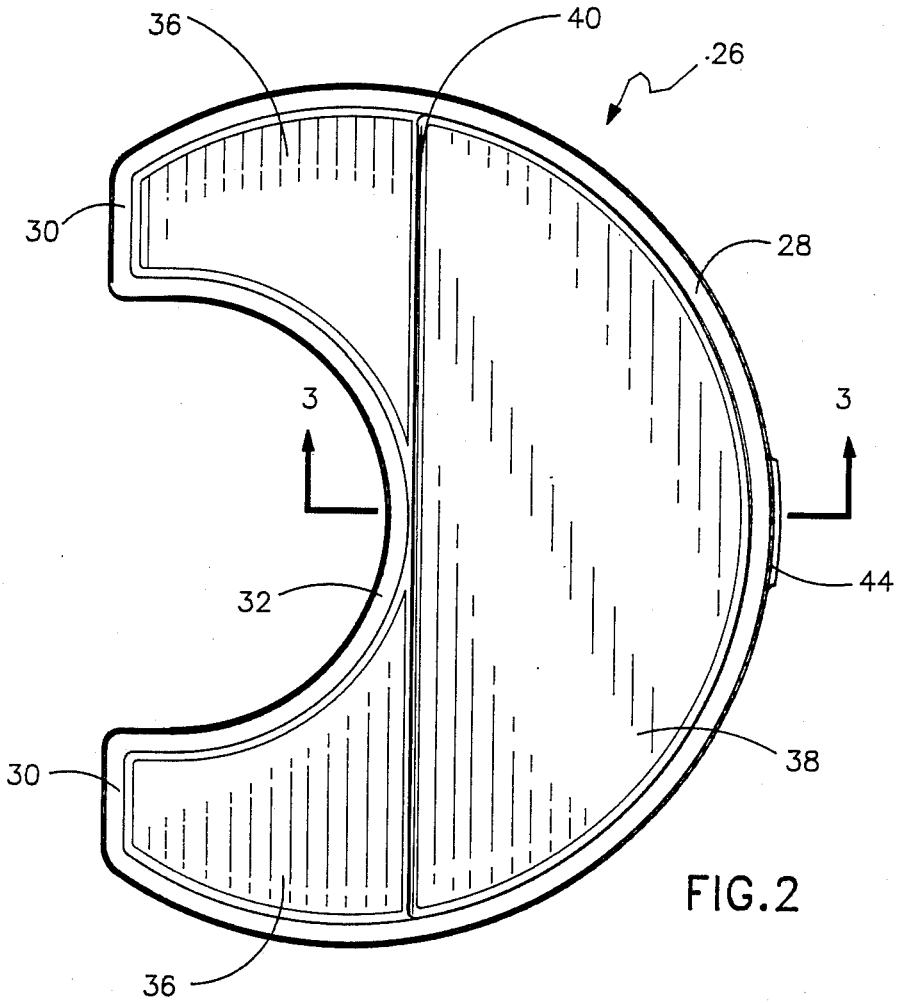
FIG. 2 is a top view of the tray.
Figure 3:
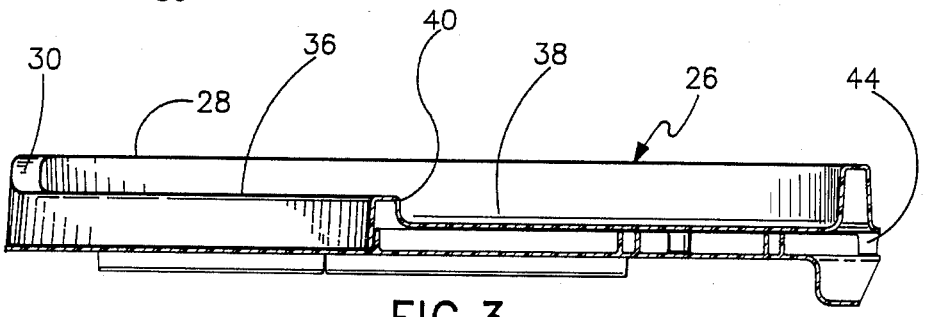
FIG. 3 is a lateral cross-sectional view, taken along lines 3—3 of FIG. 2, showing details of the tray.

The high chair 10 is provided with a tray 26. Referring also to FIG. 2, the tray 26 has a raised outer periphery 28. The outer periphery 28 can be defined as part of a circle of a suitable radius. Integral and contiguous with the outer periphery 28 are transition portions 30, which are located at the back of the tray 26. Inward of the transition portions 30 and integrally formed therewith is an inner periphery 32, which defines a cut-out area of the tray 26 that is adjacent to a child seated in the chair 10 when the tray 26 is in position. Raised portions 36 located near the back of the tray 26 are provided on which a child may rest his or her arms. As can best be seen in FIG. 4, the peripheral transition portions 30 slant in an upward direction towards the outer periphery 28 and adjacent to the back part of the arm rest areas 36. The tray 26 has a substantially flat forward section or portion 38 to provide a surface for toys, food, etc. The raised arm rest areas 36 and the flat forward section 38 are separated by ridge 40. The ridge 40 provides a barrier to separate the forward section 38 from the arm rest areas 36 thereby preventing food spills and the like from reaching the arm rest areas 36, as well as preventing the same from spilling over the inner periphery 32. A slot 42 is formed in the tray 26 for receiving a handle 44, which is provided for operating the latching mechanism. Preferably, the handle 44 is located at the center front bottom portion of the tray 26.

This tray configuration provides a number of useful advantages. First, the raised outer periphery 28 contains spills. Second, the shape of the tray 26, which is a portion of a circle, maximizes the surface area while minimize the distance from the outer periphery 28 to the child. The raised arm rest areas 36 in combination with the inner periphery 32 provide a relatively flat surface for the comfort of the child. Additionally, because the transition portions 30 are inclined in an increasing fashion in a direction away from the child, the child is able to comfortably rest his or her arms on the rest areas without interference from raised peripheral portions of the tray and yet still contain spills on the tray 26 so that they do not end up on the child or on the floor.

Figure 4:
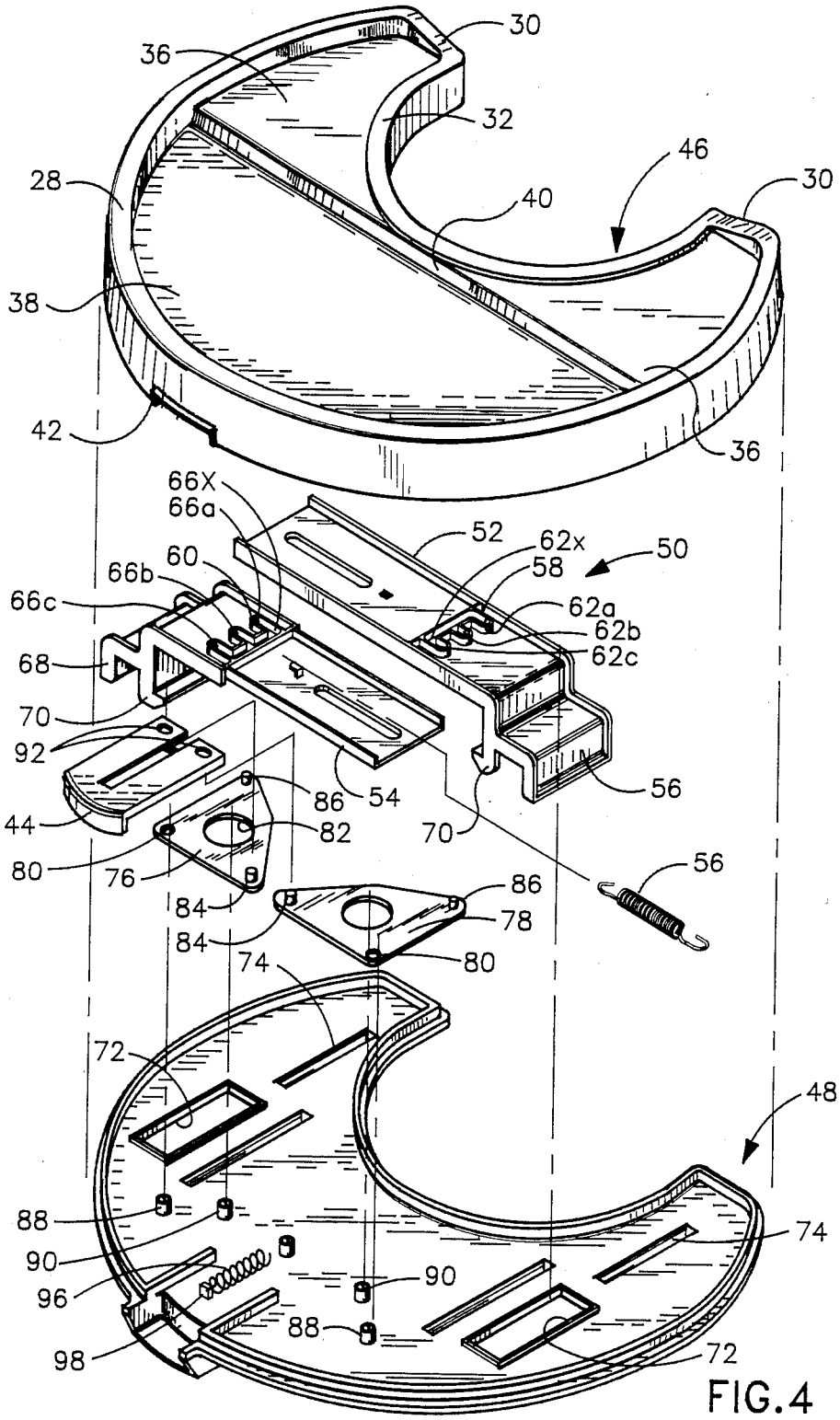
FIG. 4 is an exploded view of the tray apparatus showing details of the latching mechanism.

FIG. 4 is an exploded view illustrating the tray 26 as including an upper tray section 46, the lower tray section 48 and various parts of the latching mechanism or assembly 50. The latching mechanism 50 comprises a first latch member 52 and a second latch member 54. The two latch members 52, 54 are slidingly connected and biased in an inward direction by a latch member spring 56. The first and second latch members 52, 54 each have a tray adjustment network 58, 60. The tray adjustment network comprises parallel channels 62*a*, 62*b*, 62*c* and a perpendicular common channel 62*x*, which communicates with each of the channels 62*a*–62*c*. Likewise, the tray adjustment network 60 comprises parallel channels 66*a*, 66*b*, 66*c* and a perpendicular common channel 66*x*. In the present embodiment there are three parallel channels but it will be understood that there can be any number of such channels from two on up. The number of parallel channels determines the number of positions in which the tray 26 can be adjusted relative to the back of the high chair 10. The distance between the parallel channels determines the distance between each discrete adjustment position.

At the outer end of each of the first and second latch members 52, 54 is a side handle 68 and an engagement arm or member 70. The side handle 68 and engagement member 70 protrude below the lower tray section 48 through an engagement slot 72. The engagement member 70 is used to engage the corresponding attachment area 20 located in the high chair arms 18. The lower tray section 48 includes arm guides 74 which protrude from the underside of the tray 26 so that when the tray 26 is placed on the high chair 10, the arm guides 74 are on each side of the upper surfaces 22 of the arms 18 and therefore prevent the tray 26 from moving from side to side.

The first and second latch members 52, 54 are operated by the dual action handle 44 and two pivot plates 76, 78. Each of the pivot plates 76, 78 comprises pivot peg holes 80, guide holes 82, handle pegs 84, and adjustment pegs 86. On the lower section 48 of the tray 26 there are corresponding pivot pegs 88, which engage the pivot peg holes 80, and guide pegs 90 which are located inside the guide holes 82. The dual action handle 44 contains two handle holes 92 through which the handle pegs 84, located on the pivot plates 76, 78, are received. A handle spring 96 is located between a spring peg 98 on the lower tray section 48 and the dual action handle 44. This spring 96 operates in the compressive mode. When the dual action handle 44 is pulled outward from the tray 26, the spring 96 is compressed and when the handle 44 is released the spring 96 returns the handle 44 to its initial position.

Figure 5:
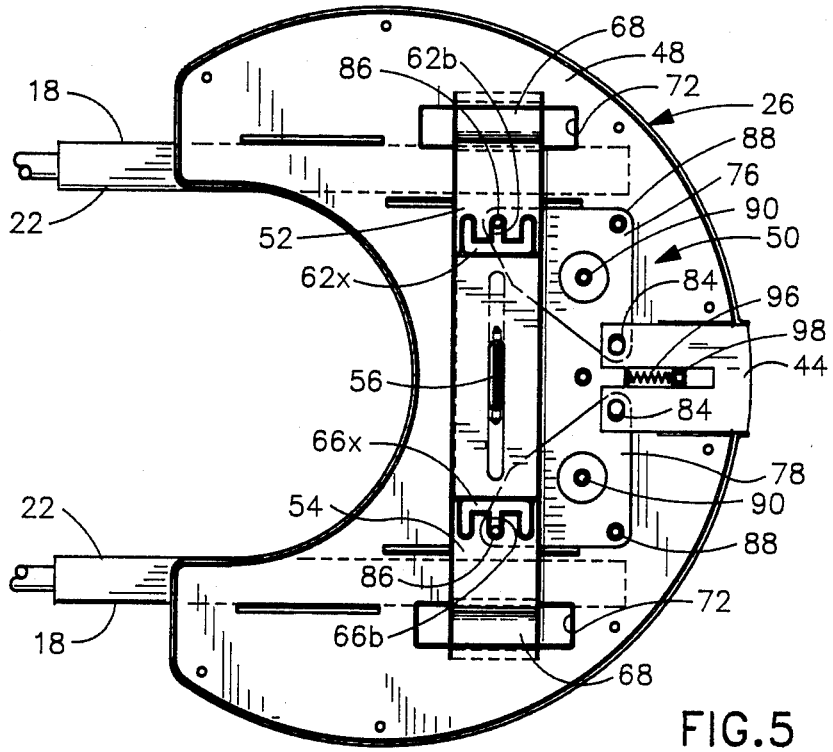
FIG. 5 is a top view of the tray apparatus with the upper surface removed to expose the latching mechanism with the tray apparatus in a second position relative to the chair.

FIGS. 5–9 show a top view of the tray 26 resting on the upper surfaces 22 of the chair arms 18. The upper tray section 46 has been removed in these drawings in order to provide a view of the latching mechanism 50. In FIG. 5 the latching mechanism 50 is in a selected one of a plurality of positions. The adjustment pegs 86 are in the middle channel 62*b* of the three parallel channels 62*a*–62*c*. As can be seen, in this position the first 52 and second 54 latch members are located at an intermediate position in the engagement slots 72. In this position the tray 26 is locked securely to the arms 18 of the chair 10 by the engagement members 70 of the latching mechanism 50, each of which is engaging or latching with the corresponding tray engagement area 20, which is located on each of the chair arms 18. In the present embodiment, the first engagement member 70 on the first and second latch members 52, 54 are protruding male engagement members which mate with female engagement members or the attachment area 20 formed in the chair arms 18. It will be understood that this relationship can be reversed. In other words, there could be protruding male members located on the arms 18 and corresponding female members on the first and second latch members 52, 54.

Figure 6:
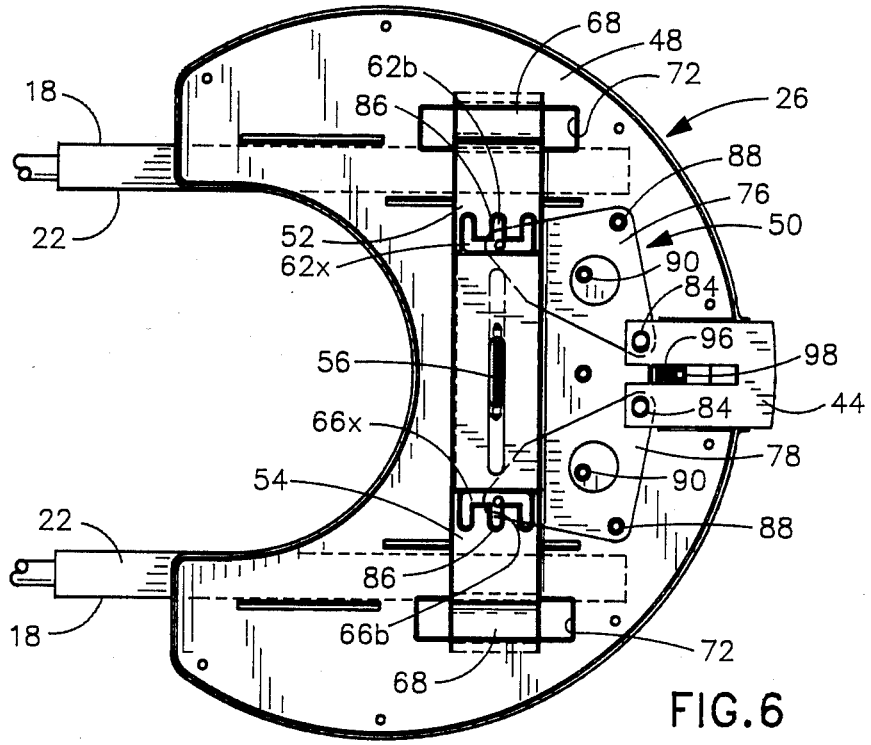
FIG. 6 is a top view of the tray apparatus with the upper surface removed to expose the latching mechanism with the latching mechanism in the adjustment mode.
Figure 7:
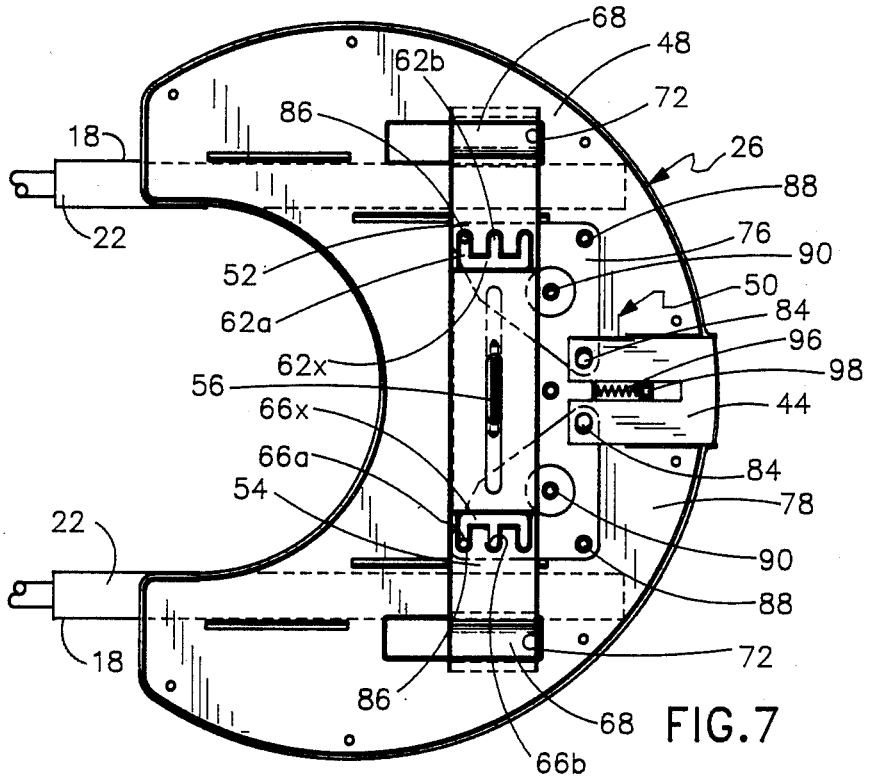
FIG. 7 is a top view of the tray apparatus with the upper surface removed to expose the latching mechanism with the tray apparatus in a first position relative to the chair.

FIG. 6 illustrates how the tray 26 can be adjusted toward or away from the back 14 of the high chair 10 while it is still securely locked to the arms 18 of the high chair 10. The dual action handle 44 is pulled outward thus compressing the handle spring 96. The handle peg holes 92 on the handle 44 which engage the handle pegs 84 on the pivot plates 76, 78 pull the pivot plates 76, 78 toward the front of the tray 26. The pivot plates 76, 78 thus rotate about the pivot pegs 90 causing the adjustment pegs 86 to travel from the closed end of the middle channel 62b of the parallel channels 62*a*–62*c* to the open end comprising the perpendicularly communicating common connecting channel 62*x*. In this position the tray 26 can be slid relative to the first and second latching members 52, 54 either toward or away from the back 14 (not shown) of the chair 10. If the tray 26 is pushed toward the back 14 and handle 44 is then released the latching mechanism 50 will assume the position shown in FIG. 7. In FIG. 7 the adjustment pegs 86 have entered the parallel channels 62*a*, 66*a* located nearest the chair 10 and the engagement slots 72 have moved relative to the first and second latching members 52, 54 which are now located toward the forward ends of the engagement slots 72. In this position, the tray 26 is located in the adjustment position that is closest to the back 14 of the chair 10.

Figure 8:
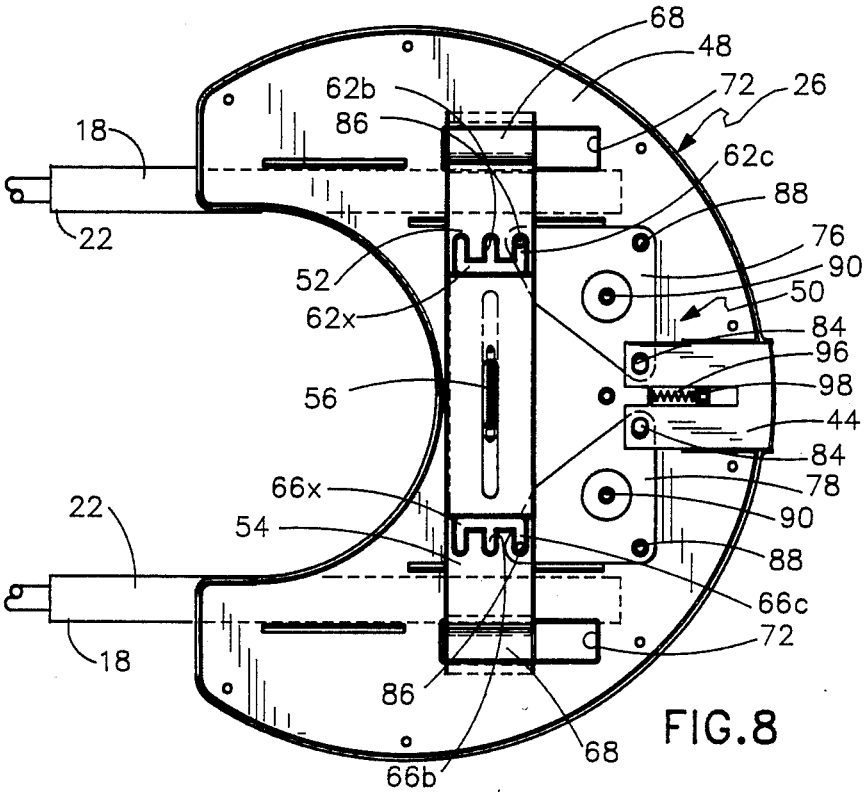
FIG. 8 is a top view of the tray apparatus with the upper surface removed to expose the latching mechanism with the tray apparatus in a third position relative to the chair.

If, on the other hand, the tray 26 had been pulled away from the back 14 of the high chair 10 and the handle 44 released, the latching mechanism 50 would assume the position shown in FIG. 8. As can be seen in FIG. 8, the adjustment pegs 86 are now located in the parallel channels 62*c*, 66*c*, which are located furthest from the back 14 of the high chair 10. The engagement slots 72 have moved relative to the first and second latching members 52, 54, which are now located toward the ends of the engagement slots 72 found nearest the back 14 of the high chair 10. In this position the tray 26 has been adjusted to the position furthest away from the back 14 of the high chair 10. As mentioned before, it will be understood that additional adjustment positions can be provided merely by increasing the number of parallel channels. It should also be noted that during this entire adjustment process shown by FIGS. 5–8 the tray 26 has always been secured to the high chair 10 by the engagement members 70, which remain firmly engaged in the corresponding arm attachment areas 20. In other words, the tray 26 is adjusted toward or away from the chair back 14 by moving the tray 26 in a horizontal direction relative to the latching members 52, 54, which are fixed to the high chair arms 18 because the first engagement members 70 are engaged in the chair arms attachment areas 20. The distance the tray 26 can be moved is limited by the length of the common connecting channels 62*x*, 66*x*.

Figure 9:
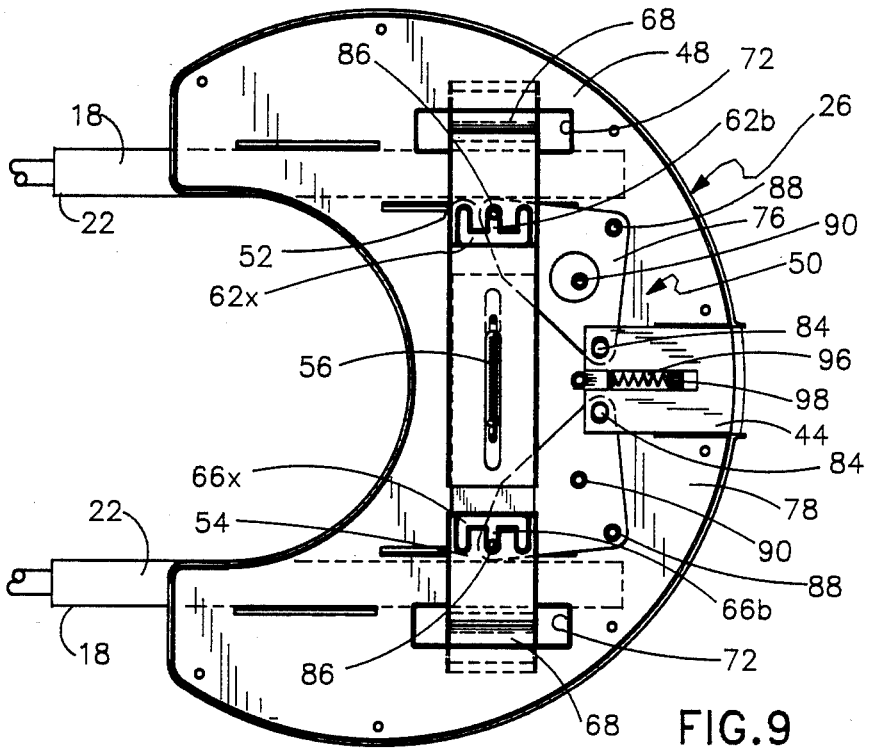
FIG. 9 is a top view of the tray apparatus with the upper surface removed to expose the latching mechanism with the latching mechanism positioned to remove the tray apparatus from the chair.

FIG. 9 illustrates how the high chair tray 26 can be disengaged and removed from the high chair 10. There are three ways of disengaging the tray 26. In a first method, the dual action handle 44 can be pressed inward. This stretches the latch member spring 56 and forces the handle pegs 84 toward the chair back 14, thus causing the pivot plates 76, 78 to pivot about the pivot pegs 90, thus causing the adjustment pegs 86 on the pivot plate 76, 78 to move in an outward direction forcing the first and second latch members 52, 54 apart. Thus, the engagement members 70 are disengaged from the corresponding attachment areas 20 located on the high chair arms 18. The tray 26 may now be either slid off of the arms 18 or lifted straight up. A second method for disengaging the tray 26 from the high chair arms 18 is to simply grasp the two side handles 68 and pull outward thus disengaging the engagement members 70 from the corresponding chair arm attachment areas 20. The latch member spring 56 will then pull the first and second latch members 52, 54 back together when the side handles 68 or the dual action handle 44 is released. This is important when the tray 26 is returned to the high chair 10, because it is the latch member spring 56 which pulls the first and second latch members 52, 54 in an inward direction so as to hold the first engagement members 70 in the associated chair arm attachment areas 20. A third method for removing the tray 26 is by pulling on one of the two side handles 68 and lifting that side of the tray, and then disengaging the opposite side handle 68 simply by moving the entire tray 26.

It will be understood from the above illustrations that when the tray 26 is returned to the high chair 10 and the arm engagement members 70 are locked in position, the tray 26 will be at the same distance from back 14 of the high chair 10 as it was when it was originally removed from the high chair 10. This illustrates the unique memory function of the latching mechanism 50. In this way the tray 26 can be removed and replaced without affecting the adjustment of the tray 26 relative to the back 14 of the high chair 10.

The above detailed description illustrates the unique configuration of the present novel high chair tray apparatus. This unique configuration comprises a circular raised outer periphery, raised arm rests, and a sunken front section. The foregoing also discloses the unique latching mechanism, which comprises a novel memory function, a one or two-handed removal operation, and one-handed adjustment without removing or disengaging the tray from the high chair.

While various embodiments of the present invention have been described in detail, it is apparent that modifications and adaptations of those embodiments will occur to those skilled in the art. However, it is to be expressly understood that such modifications and adaptations are within the spirit and scope of the present invention as set forth in the following claims.

What is claimed is:

1. A tray apparatus for use with a chair, comprising:

first means for use in attaching the tray apparatus to the chair at a substantially fixed predetermined attachment area; and second means operatively associated with said first means for use in selectively positioning the tray apparatus at one of a plurality of discrete and substantially fixed positions relative to the chair, said second means being movable wherein said second means moves to permit postioning the tray apparatus from one of said positions to another of said positions while said first means maintains attachment of the tray apparatus to the chair during the movement of said second means.

2. A tray apparatus, as claimed in claim 1, wherein:

said first means is integrally formed with a portion of said second means and said first means slides linearly when said second means is moved.

3. An apparatus for positioning a tray at a desired location relative to a chair having a predetermined attachment area, comprising:

a latch assembly connected to the tray, said latch assembly including engagement means and wherein said latch assembly is movable to position the tray at a selected one of a plurality of discrete and substantially fixed positions relative to the chair, said engagement means being joined to the chair at its attachment area wherein the attachment area of the chair remains substantially the same regardless of which selected one of said plurality of discrete and substantially fixed positions is selected.

4. An apparatus, as claimed in claim 3, wherein:

said latch assembly includes a handle wherein movement of said handle in a first direction permits movement of the tray in one direction and movement of said handle in a second direction permits movement of the tray in another direction.

5. An apparatus for moving a tray relative to a chair and for removing the tray from the chair, comprising:

a tray;

a handle operatively connected to said tray; and a movable latch assembly operatively associated with said tray, wherein movement of said handle in a first direction permits movement of said tray in a substantially horizontal direction whereby said tray can be re-positioned relative to the chair and movement of said handle in a second direction, opposite from said first direction, permits movement of said tray in a substantially vertical direction whereby said tray can be removed from the chair while controllably not permitting movement of said tray relative to said latch assembly.

6. A tray having an upper section for use with a chair, comprising:

a cutout section for accommodating portions of the torso of a child when sitting in the chair, said cutout section having a front edge located farthest from the back of the chair in comparison with remaining portions of said cutout section;

a back tray section disposed nearest to the back of the chair when the tray is attached to the chair, said back tray section extending from the back of said tray to at least said front edge of said cutout section, said back tray section being raised relative to the average vertical height of the upper section in order to provide an area on which a child seated in the chair may rest her arms, wherein said back tray section includes peripheral tray portions which are inclined toward an outer periphery of the tray such that the vertical height of said peripheral tray portions increases in a direction towards said outer periphery whereby comfort of the child's arms and containment of spills are enhanced; and a front tray section disposed further way from the back of the chair than said back tray section, the average vertical height of said front tray section being lower than the average vertical height of said back tray section.

7. The tray of claim 6, wherein:

the tray upper section further comprises a raised rim disposed about said outer periphery of the tray.

8. The tray of claim 6, wherein:

said outer periphery of the tray consists essentially of a portion of a circle.

9. The tray of claim 7, wherein the entire shape of said outer periphery is that of a portion of a circle.

10. A tray apparatus for use with a chair, comprising:

a tray;

attachment means for attaching said tray to the chair and wherein said attachment means remains attached to the chair while said tray is movably adjusted in a horizontal direction toward or away from the back of the chair;

slideable securement means for securing said tray to said attachment means while allowing said tray to move relative to said attachment means toward and away from the back of the chair; and latching means connected to said tray which:

(i) when engaged, locks said tray in one of at least two discrete positions wherein movement of said tray relative to said attachment means is prevented, and (ii) when disengaged, permits said tray to move relative to said attachment means in a horizontal direction toward and away from the back of the chair to another one of at least two discrete positions.

11. The tray apparatus of claim 10, wherein:

said attachment means comprises a male element on said tray which engages a female element on the chair.

12. The tray apparatus of claim 10, wherein said attachment means comprises:

two first engagement means on said tray which engage two corresponding second engagement means located on each of two arms of the chair;

means for slidably connecting said two first engagement means wherein said two first engagement means are movable in a direction perpendicular to the direction in which said tray is movably adjusted; and bias means for pulling said two first engagement means towards each other so that, when said two first engagement means engage said corresponding second engagement means, said bias means maintains the engagement.

13. The tray apparatus of claim 12, wherein:

said tray comprises two handles attached to each of said first two engagement means so that when said handles are pulled in an outward direction, said first two engagement means can disengage from said two corresponding second engagement means.

14. The tray apparatus of claim 12, wherein:

said tray further comprises a single lever which is mechanically connected to each of said two first engagement means so that, when said single lever is operated, said first two engagement means can disengage from said two corresponding second engagement means.

15. The tray apparatus of claim 10, wherein:

said slideable securement means comprises slots in said tray which receive said attachment means and which allow said tray to move relative to said attachment means in a horizontal direction toward and away from the back of the chair, while at the same time substantially restricting the movement of said attachment means in all other directions.

16. A tray apparatus for use with a chair, comprising:

(1) a tray;

(2) attachment means for attaching said tray to the chair and wherein said attachment means remains attached to the chair while said tray is movably adjusted in a horizontal direction toward or away from the back of the chair;

(3) slidable securement means for securing said tray to said attachment means while allowing said tray to move relative to said attachment means toward and away from the back of the chair; and (4) latching means comprising:

(a) a plurality of first channels, parallel to each other and substantially perpendicular to the direction in which said tray is movably adjustable;

(b) a second channel, perpendicular to said first channels, which connects an open end of each of said first channels together so that said first channels each have an open end which is connected to the open end of the other first channels by said common second channel, and each of said first channels has a closed end which is isolated from the other first channels;

(c) a peg movably received in said first and second channels; and (d) positioning means for allowing relative movement between said peg and said first and second channels so that when said positioning means is:

(i) engaged, said peg is positioned toward the closed end of one of said first channels, thereby locking said tray in one of at least two discrete positions thus preventing said tray from moving relative to said attachment means; and (ii) disengaged, said peg is positioned toward the open end of said first channels, thereby allowing said peg to move relative to said second channel which in turn allows said tray to move relative to said attachment means in a horizontal direction toward or away from the back of the chair until the latching means is once again engaged, thus allowing the peg to leave said second channel via the open end of a first channel and move towards the closed end of one of said first channels to once again lock said tray in another one of at least two discrete positions.

17. A tray apparatus for use with a chair, comprising:

two first engagement means on said tray which engage two corresponding second engagement means located on each of two arms of the chair;

means for slidably connecting said two first engagement means wherein said two first engagement means are movable toward the sides of said tray;

bias means for pulling said two first engagement means towards each other so that, when said two first engagement means engage said corresponding second engagement means, said bias means maintains the engagement;

two handles attached to each of said first two engagement means so that, when said handles are pulled in an outward direction, said first two engagement means can disengage from said two corresponding second engagement means; and single lever connected to each of said two first engagement means which is operative when moved in a first direction and which is operative when moved in a second direction wherein when said single lever is moved in said first direction, said first two engagement means can disengage from said two corresponding second engagement means and wherein when said single lever is moved in a second direction said tray can be positioned relative to said chair while said two first engagement means remain engaged with said corresponding second engagement means.

18. A method for moving a tray relative to a chair, comprising:

attaching a tray using tray engaging means to the chair;

moving a handle operatively associated with the tray;

re-positioning said tray engaging means relative to said tray upon movement of said handle by sliding said tray to a desired position relative to the chair without disengaging said tray engaging means from said chair; and releasing said handle after said tray has reached the desired position.

19. A method for changing the position of a tray relative to a chair while securing the tray to substantially the same attachment area located on the chair, comprising:

providing a chair having an attachment area;

providing a tray having movable latch means;

attaching said tray to said chair at said attachment area using at least portions of said latch means;

positioning said tray to a first desired position relative to the chair while said tray remains attached at said attachment area;

removing said tray from said chair; and re-attaching said tray to said chair at the same attachment area of said chair so that said tray is again located at said first desired position.

20. A method for moving a tray relative to a chair and for removing the tray from the chair, comprising:

providing a chair;

providing a tray including movable latch means and a handle operatively associated with said latch means;

attaching said tray to said chair;

re-positioning said tray relative to said chair after moving said handle in a first direction while said tray is attached to said chair; and removing said tray from said chair after moving said handle in a second direction opposite said first direction.

* * * * *